United States Patent [19]

Pavlik et al.

[11] Patent Number: 4,919,192

[45] Date of Patent: Apr. 24, 1990

[54] DISCRETE EXCITATION COIL PRODUCING SEAL AT CONTINUOUS CASTING MACHINE POURING TUBE OUTLET NOZZLE/MOLD INLET INTERFACE

[75] Inventors: Dennis Pavlik, Murrysville Boro; Richard D. Nathenson, Pittsburgh, both of Pa.

[73] Assignee: Westinghouse Electric Corp., Pittsburgh, Pa.

[21] Appl. No.: 323,226

[22] Filed: Mar. 10, 1989

Related U.S. Application Data

[63] Continuation of Ser. No. 201,351, May 27, 1988, abandoned, which is a continuation of Ser. No. 50,272, May 15, 1987, abandoned.

[51] Int. Cl.[5] ..... B22D 11/04; B22D 27/02

[52] U.S. Cl. ..... 164/502; 164/440

[58] Field of Search ..... 164/466, 467, 502, 503, 164/147.1, 440, 490

[56] References Cited

U.S. PATENT DOCUMENTS

| | | | |
|---|---|---|---|
| 4,462,458 | 7/1984 | Ruer | 164/504 |
| 4,469,165 | 9/1984 | Ungarean et al. | 164/467 |
| 4,516,627 | 5/1985 | Gaule et al. | 164/467 |
| 4,518,030 | 5/1985 | Gaule et al. | 164/503 |
| 4,530,394 | 7/1985 | Yarwood et al. | 164/467 |
| 4,540,037 | 9/1985 | Langner | 164/466 |
| 4,570,699 | 2/1986 | Gaule et al. | 164/503 |

FOREIGN PATENT DOCUMENTS 61-115654 6/1986 Japan ..... 164/502

*Primary Examiner*—Kuang Y. Lin

[57] ABSTRACT

An improved discrete excitation coil is provided in a continuous casting machine for generating an electromagnetic levitating and stabilizing force which acts upon the meniscus of the molten metal in a mold cavity of the machine at the region of an upper inlet to the cavity. The force counteracts the head pressure of the molten metal contained within a pouring tube which extends through the upper inlet from above the cavity and thereby providing a seal in an area of separation between the mold inlet and the pouring tube which prevents overflow of molten metal through the inlet. The excitation coil includes an outer electrical conductor which defines multiple electrical conductor turns disposed in series and being capable of carrying an electrical current of adequate density to generate the electromagnetic force. The coil also includes plural inner fluid channels which define fluid flow paths being surrounded by, and in contact with, the outer electrical conductor. The inner fluid channels are less in number than that of the multiple turns, and disposed in parallel to, but independent of, one another and in close proximity to the multiple turns. Coolant fluid circulated in the independent flow paths of the inner fluid channels can thereby provide sufficient cooling of the multiple turns to facilitate conduction therethrough of a high enough density electrical current to produce the required electromagnetic force.

8 Claims, 3 Drawing Sheets

DISCRETE EXCITATION COIL PRODUCING SEAL AT CONTINUOUS CASTING MACHINE POURING TUBE OUTLET NOZZLE/MOLD INLET INTERFACE

This application is a continuation of application Ser. No. 201,351, filed May 27, 1988, now abandoned, which in turn is a continuation of application Ser. No. 050,272, filed May 15, 1987, now abandoned.

BACKGROUND OF THE INVENTION

1. Field of the Invention

The present invention relates generally to the field of continuous casting of metals, such as steel and, more particularly, is concerned with a discrete excitation coil incorporating multiple electrical conductor turns and independent hydraulic fluid flow paths for cooling the electrical conductor turns in order to produce a levitating and stabilizing force on the meniscus of the liquid metal sufficient to effectively seal the pouring tube outlet nozzle/mold inlet interface in a continuous casting machine.

2. Description of the Prior Art

Horizontal continuous casting of metals, such as steel, into the form of billets, slabs and the like are enjoying increasing interest in the continuous casting art. A preferred horizontal continuous casting method is to utilize a tundish which feeds molten metal via a pouring tube downwardly through a top inlet of a horizontal continuous casting mold. The pouring tube has an outlet nozzle which extends through the top inlet of the mold and into the pool of molten metal contained therein. The mold includes interconnected top, bottom and opposite side walls which contain the molten metal in the pool thereof below the top inlet and also typically define plural outlet ports through which solidifying strands of the metal in billet of slab form are independently withdrawn from the mold. A representative example of a horizontal continuous casting machine is disclosed in U.S. Pat. No 4,540,037 to Langner.

Typically, the horizontal continuous casting mold is oscillated in the horizontal direction in order to obtain a problem-free withdrawal of the strands and to realize a satisfactory surface quality of the casting. However, in order to minimize the amount of mass which must be oscillated and thus the complexity of the machine, it is advantageous to maintain the tundish and pouring tube stationary relative to the oscillating mold. It is therefore necessary to provide sufficient space at the interface between the pouring tube outlet nozzle and an annular rim formed in the top wall which defines the mold top inlet to allow such relative movement.

The amount of mold oscillation required is dependent on factors such as slab dimensions and casting temperature. For instance, oscillations of plus or minus three-eights inch are typical for slabs six by thirty inches in cross-section and composed of steel. This also necessitates that at the pouring tube outlet nozzle/mold inlet interface, a minimum mechanical clearance of at least three-eights inch must be provided to accommodate the oscillation.

Various approaches to sealing the inlet nozzle/mold inlet interface have been proposed, such as mechanical sliding seals, elastic or bellows-type seals, and high pressure air or inert gases. None of these methods have been successful. Specifically, the mechanical sliding seals were quickly found to develop leaks at the high temperatures and high duty cycles. The pressurized air-jet approach has been discarded due to the fact that it introduces air bubbles into the molten steel, deteriorating the tensile strength of the finished product.

One sealing approach that appears to have promise is to use a single-phase electromagnetic coil wound around the inlet nozzle, such as shown in the above-cited U.S. Pat. No. 4,540,037 to Langner. The coil has usually been made up of only a few turns, and typically has an excitation strength of 80,000 to 150,000 ampere-turns for pouring tube nozzle inlet diameters no greater than 5 inches. The large ampere-turn excitations are necessary because the height of the ferrostatic molten metal head extending from the tundish to the outlet nozzle of the pouring tube is often rather deep (such as 36 inches) and can be on the order of 10 psi. However, because of the high excitation ampere-turns and few turns, large line currents are required. These current levels are only available at the suboptimal power line frequencies of from about 50 to 60 Hertz.

Several major obstacles are presented by the use of a coil having relatively few turns. One obstacle is that the magnitude of the levitating or stabilizing force exerted on the molten metal in the pouring tube outlet nozzle region is too low to counteract typical ferrostatic heads in common use in large commercial casting systems. Another obstacle is that having only a few turns (1 to 3) means that the main lead current is on the same order of magnitude as the excitation ampere-turn requirement. This is an extremely inefficient arrangement in that the high currents (33–150 kilamps) required are not available at the optimum levitating frequencies (100–1000 Hertz) and although currents in this range have been supplied at power line frequencies (50 to 60 Hertz) it is impractical to supply such high currents given size and space limitations associated with continuous casting machines. Further, the main leads from the power source to the coil are much longer than the excitation coil length (for instance, 100 feet compared to 15 feet) and represent a more difficult cooling problem than the coil itself. Also, the few turns are of necessity relatively large in size and have a high "eddy factor"(eddy factor is the ratio of effective electrical conductor resistance at rated frequency to the conductor's electrical resistance to d.c. current). Additionally, there is a non-uniform magnetic field distribution about the periphery of the excitation coil. Yet another obstacle is that the discrete coil requires that an external mechanical frame support the coil and further that electrical insulation be provided between the coil and the mold. These requirements usually cause the distance between the bottom of the lowermost coil conductor and the melt meniscus to be unnecessarily large, reducing the electromagnetic pressure considerably.

A variant of the above approach of using a discrete coil with few turns is the use of a single-turn copper casting integral to the mold. While a significant advantage of this variant approach is that the current path is concentrated in an extremely robust, compact circuit close to the molten metal without the need for insulation, several major drawbacks are also present. One drawback is that, again, the supply current must be numerically equal to the excitation ampere-turns (e.g., 100,000 amperes). As mentioned earlier, this is an extremely high value and would require a complicated cooling scheme to keep the main lead conductors cool over their long length. Another drawback is that the current in the integral mold design would tend to concentrate at the top, outer surface rather than preferably at the bottom section near the molten metal. Still another drawback is that there exists at two points about the metal meniscus a magnetic null point either in the insulation space between inlet and outlet conductor leads or where the current divides in a one-half turn type arrangement.

In view of the aforementioned obstacles and shortcomings, a need still remains to find a practical way to use electromagnetic pressure as a seal around the pouring tube inlet nozzle. It appears certain that, in order for any alternative approach to have a chance for succeeding, it must address and eliminate the aforementioned obstacles and shortcomings of the prior discrete and integral coil arrangements.

SUMMARY OF THE INVENTION

The present invention provides a discrete excitation coil which produces an outlet nozzle/mold inlet interface seal designed to satisfy the aforementioned needs. The discrete excitation coil of the present invention eliminates the aforementioned obstacles and shortcomings of the prior discrete and integral coil arrangements by addressing and satisfactorily resolving all problems of heat transfer, power supply, main lead design and electrical insulation.

Particularly, the discrete excitation coil of the present invention incorporates multiple electrical conductor turns in series, for instance on the order of 30 to 40 turns. This is an order of magnitude greater than the number of turns considered to be the practical maximum in the prior art. The multiple turns of the excitation coil are capable of carrying an electrical current of adequate density to generate a levitating and stabilizing electromagnetic force on the meniscus of the liquid metal at the mold inlet that is sufficient to provide an effective seal at the interface between the pouring tube outlet nozzle and mold inlet of the continuous casting machine.

Further, the excitation coil also employs several hydraulic fluid paths in parallel to, but independent of, one another and in close proximity to the electrical conductor turns. Preferably, the fluid paths are isolated from the electrical conductor turns, however, the fluid paths can be formed by the conductor turns. Coolant circulated in these independent hydraulic fluid paths provide sufficient cooling of the electrical conductor turns to facilitate conduction therethrough of a high enough density electrical current to produce the required levitating and stabilizing electromagnet force.

The important advantages of this alternative approach over the ones proposed heretofore are as follows. First, the main lead current is only a small fraction of the excitation ampere-turns (e.g., 2000 amps as compared to 100,000 amps). This current level is easily supplied over the practical range of levitation frequencies for this application (100 to 1000 Hertz). Second, there is improved space utilization in the excitation coil region. The smaller conductors can have an improved eddy factor and can be more efficiently cooled, so that the effective coil current density is increased as compared to the prior approaches. Third, the coil conductor arrangement is conductive to multiple independent cooling paths. This further increases the effective operating current density of the coil. Fourth, there are no significant local perturbations in the magnetic field about the periphery of the coil. Fifth, since direct control and placement of the excitation ampere-turns is critical to achieving sufficient levitation force, the numerous small conductors allow for the accurate placement of the excitation ampere-turns in an optimum distribution. Furthermore, there is no significant redistribution of the current within the coil during operation, as would occur in the few large turns or integral coil/mold excitation in the prior art which would result in degradation of the effectiveness of the excitation in creating levitation forces in the material to be levitated. Sixth, in addition to the large decrease in supply current afforded by having many turns, the many-turn coil also opens the possibility for further significant reductions in the supply current magnitude and the size of the power supply through the use of "resonant tuning". Resonant tuning is a well developed technique in induction heating systems whereby a capacitor is placed electrically in parallel with the induction coil (in this case the levitating coil).

Accordingly, the present invention is directed to an improved discrete excitation coil set forth in a continuous casting machine. The continuous casting machine includes a generally horizontal continuous casing mold having an upper inlet, an internal cavity communicating with and disposed below the inlet for receiving molten metal through the inlet into the cavity, and at least one outlet communicating with the cavity for withdrawing a strand of solidifying metal through the outlet from the cavity. The machine also includes a pouring tube disposed above the mold and having an outlet nozzle portion which extends downwardly through the mold inlet into the mold cavity.

The discrete excitation coil is provided for generating an electromagnetic levitating and stabilizing force which acts upon the meniscus of the molten metal in the mold cavity at the region of the mold inlet for counteracting the head pressure of the molten metal contained within the pouring tube and thereby providing a seal in the area of an interface between the mold inlet and the outlet nozzle portion of the pouring tube. In particular, the excitation coil comprises: (a) means defining multiple electrical conductor turns disposed in series and being capable of carrying an electrical current of adequate density to generate the electromagnetic levitating and stabilizing force; and (b) means defining plural hydraulic fluid flow paths being less in number than that of the multiple turns, and disposed in parallel to, but independent of, one another and in close proximity to the multiple turns. Coolant fluid circulated in the independent flow paths can thereby provide sufficient cooling of the multiple turns to facilitate conduction therethrough of a high enough density electrical current to produce the required electromagnetic levitating and stabilizing force.

More specifically, the means defining the multiple turns of the excitation coil is an outer electrical conductor, whereas the means defining the plural fluid flow paths are plural inner fluid channels being surrounded by, and in contact with, the outer electrical conductor. In one embodiment, the outer electrical conductor is in the form of a solid conductive metal tube and the inner coolant channels are in the form of hollow passages formed in the solid tube. In another embodiment, the outer electrical conductor is formed by an annular arrangement of electrically conductive metallic strands and the inner coolant channels are in the form of low-conductive tubes surrounded by the conductive strands.

These and other advantages and attainments of the present invention will become apparent to those skilled in the art upon a reading of the following detailed description when taken in conjunction with the drawings.

BRIEF DESCRIPTION OF THE DRAWINGS

In the course of the preceding discussion and following detailed description, reference has been and will be made to the attached drawings in which.

DETAILED DESCRIPTION OF THE INVENTION

Figure 1:
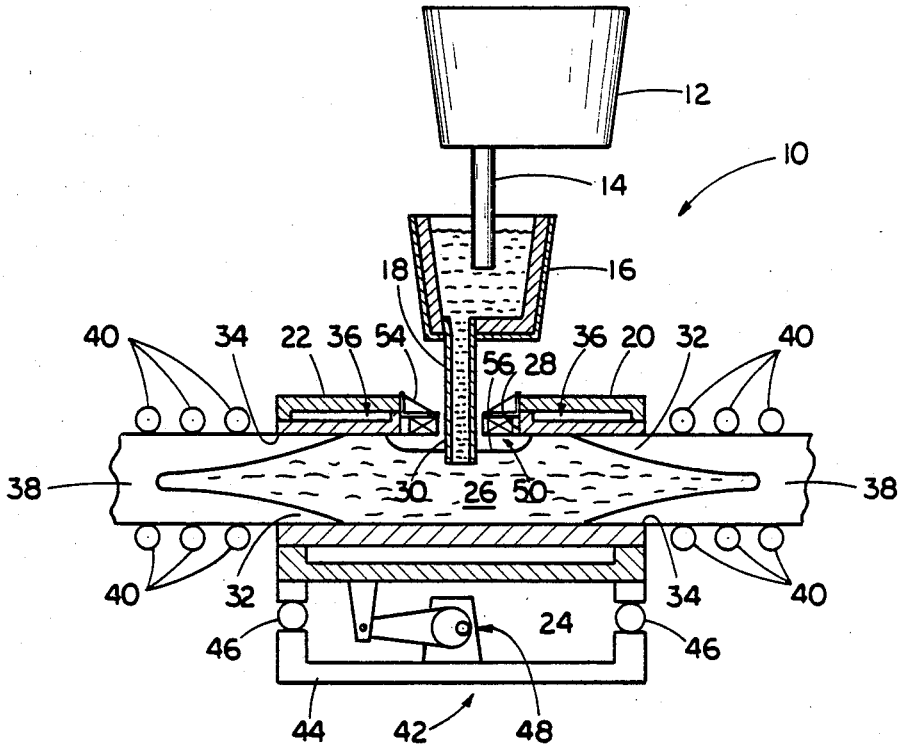
FIG. 1 is a schematic side elevational view of an exemplary embodiment of a horizontal continuous casting machine incorporating the discrete excitation coil of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

In General

Referring now to the drawings, and particularly to FIG. 1, there is illustrated a horizontal continuous casting machine, generally designated by the numeral 10, adapted for continuous casting of various types of strands, for instance billets, of metal, such as steel. The continuous casting machine 10 includes a suitable supply vessel, such as a casting ladle 12, from which issues a hot molten metal stream through a first pouring tube 14 into a further supply vessel, such as a tundish 16. The tundish 16, in turn, infeeds the molten metal contained therein through a second pouring tube 18 into a generally horizontal continuous casting mold 20.

The continuous casting mold 20 has generally horizontal, spaced apart top and bottom walls 22,24 being interconnected by generally vertical, spaced apart side walls (not shown) which define an internal cavity 26. A generally circular upper inlet 28 is formed in the top wall 22 of the mold 20 which communicates with the cavity 26 being located therebelow. The mold cavity 26 receives molten metal through the upper inlet 28 from the tundish 16 via an outlet nozzle portion 30 of the second pouring tube 18 which extends downwardly into the central region of the cavity. The mold cavity 26 has a pair of opposite compartments 32 with corresponding outlets 34. The mold 20 is formed of a good thermally conductive material, such as copper, which is chilled by a coolant, such as water, circulated through cooling passages 36 formed in its walls 22,24 to initiate solidification of the molten metal as it flows in opposite directions into the cavity compartments 32.

Partially solidified metal strands 38 formed in the two mold compartments 32, respectively, are simultaneously bidirectionally withdrawn in opposite directions through the outlets 34 by suitable withdrawal devices, such as pairs of synchronized driven pinch rolls 40. To prevent the continuously casted strands 38 from adhering to the walls of the mold 20 and to one another, the mold is constantly oscillated horizontally along its longitudinal axis by a mold oscillation mechanism, generally indicated at 42. The mold oscillation mechanism 42 includes a mold table 44 upon which is supported rollers 46 rotatably attached to the bottom mold wall 24. A suitable oscillating drive unit 48 is coupled to the bottom wall 24 of the mold 20 for reciprocally oscillating the same essentially horizontally. Although the amount of oscillation travel is dependent on factors such as slab dimensions and casting temperatures, oscillations typically amount to a fraction of an inch. For example, for casting a slab six by thirty inches and composed of steel, oscillations of plus or minus three-eights of an inch are typical.

In view that the mold 20 is oscillated relative to the tundish 16 and second pouring tube 18, the mold upper inlet 28 must be of a size sufficient to not only accommodate the lower outlet nozzle portion 30 of the second pouring tube 18 but to also permit the oscillatory movement to be satisfactorily performed. The radial separation or space between the mold 20 and second pouring tube 18 at the region of the interface between the pouring tube outlet nozzle portion 30 and mold upper inlet 28 must be somewhat greater than the oscillating stroke.

Improved Discrete Excitation Coil

Figure 2:
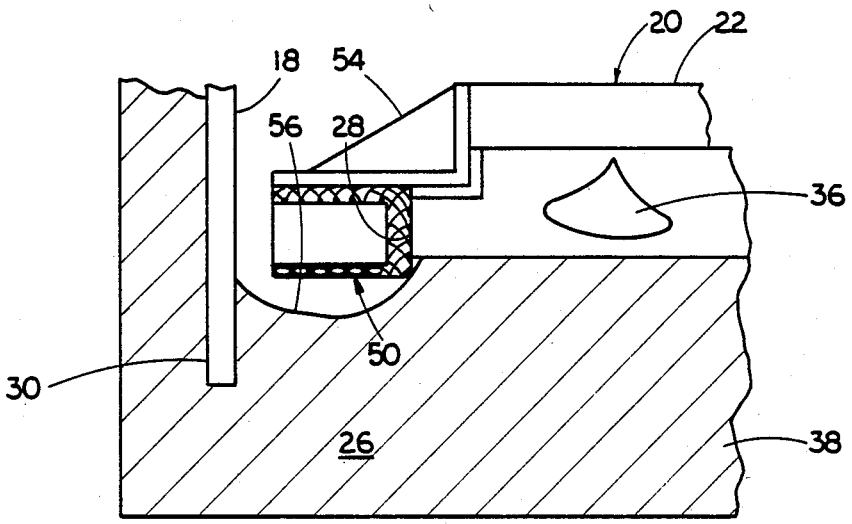
FIG. 2 is an enlarged cross-sectional view of a fragmentary portion of the machine of FIG. 1, showing the mounting of the coil to the mold.

To ensure that the infed molten metal will not tend to splash out of or overflow the upper mold inlet 28 during mold oscillation, especially due to the pressure of the molten metal head located above the mold 20, an electromagnetic sealing device in the form of an improved discrete excitation coil 60 is supported coaxially about the pouring tube 18 in the space or separation between its outlet nozzle portion 30 and an internal annular rim portion 52 of the mold top wall 22 defining the upper inlet 28. As seen in FIGS. 1 and 2, the coil 60 is preferably supported to the wall rim portion 52 by an annular support member 54.

The discrete excitation coil 50, being powered by any suitable alternating-current power source (not shown), generates an electromagnetic levitating and stabilizing force. The electromagnetic force acts upon the meniscus 56 of the molten metal in the cavity 26 at the region of the upper inlet 28 so as to counteract the head pressure of the molten metal contained within the second pouring tube 18. In such manner, the force generated by the coil 50 provides a seal in the area of the interface between the mold upper inlet 28 and the outlet nozzle portion 30 of the second pouring tube 18 which prevents overflow of molten metal through the upper inlet 28.

Figure 3:
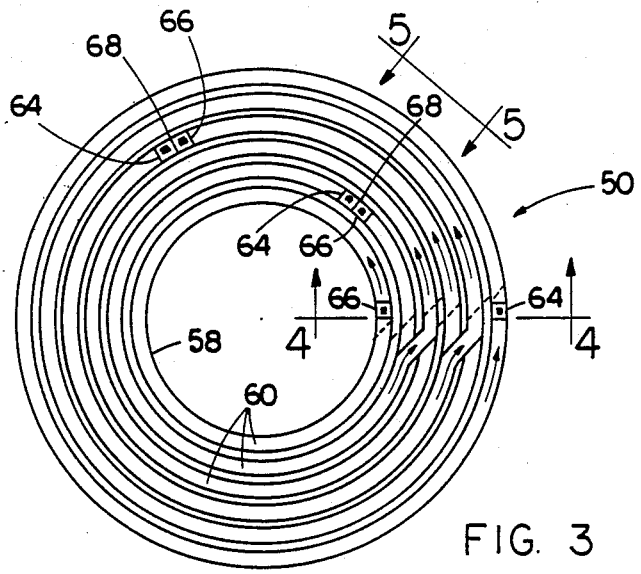
FIG. 3 is a plan view of one embodiment of the discrete excitation coil of the present invention.
Figure 4:
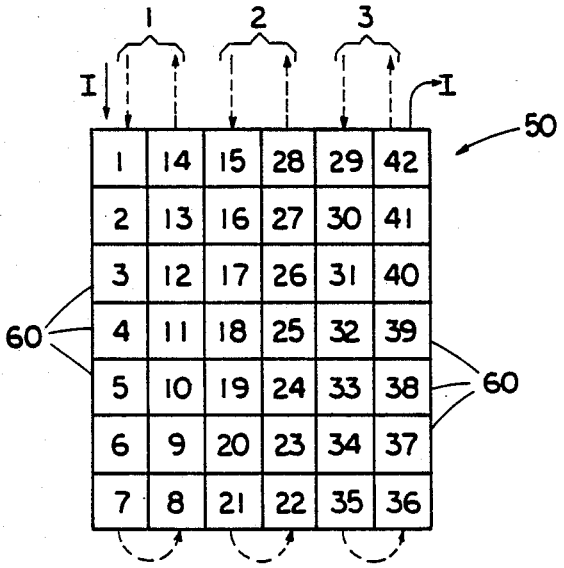
FIG. 4 is a diagrammatic representation of a cross-section of the coil taken along line 4—4 of FIG. 3, illustrating the conductor turns as square boxes numbered in the sequence in which the serially-connected turns are wound into the coil and also illustrating the independent coolant flow paths in dashed line form.
Figure 5:
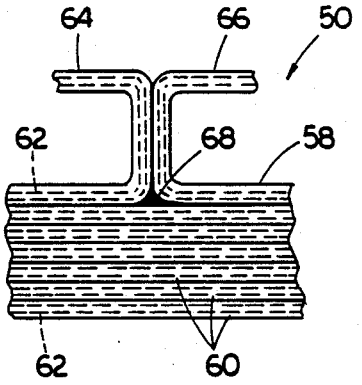
FIG. 5 is a side elevational view of a fragmentary portion of the coil of FIG. 3, showing the ends of one of the independent hydraulic coolant fluid flow paths.

Turning now to FIGS. 3-5, one embodiment of the improved discrete excitation coil 50 is shown in detail. The coil 50 basically includes means in the form of an outer electrical conductor 58 which defines multiple electrical conductor turns 60 connected in series and being capable of carrying an electrical current of adequate density to generate the electromagnetic force. The coil 50 also includes plural inner fluid channels 62 which define fluid flow paths being surrounded by, and in contact with, the outer electrical conductor 58. The inner fluid channels 62 are less in number than the number of the multiple turns 60 of the conductor 58. The number of conductor turns 60 defined by the conductor 58 of coil 50 is at least six times greater than the number of fluid flow paths defined by the fluid channels 62, as seen in FIGS. 4 and 8-10. In the embodiment seen in FIG. 4, there are forty turns 60 in the conductor 58, whereas there are only three fluid channels 62.

The inner fluid channels 62 are disposed in parallel to, but independent of, one another and in close proximity to, but preferably isolated from, the multiple turns 60 of the conductor 58. Coolant fluid circulated in the independent flow paths of the inner fluid channels 62 can thereby provide sufficient cooling of the multiple conductor turns 60 to facilitate conduction therethrough of a high enough density electrical current to produce the required electromagnetic force. For example, the force required for use in continuous steel casing must typically be capable of providing on the order of a 9 psi levitating pressure.

FIG. 4 schematically illustrates the coil 50 which, as mentioned above, has forty-two turns 60 connected electrically in series and three channels 62 defining three independent hydraulic coolant flow paths. In this configuration, electrical current flows progressively from turn #1 to #42. It is assumed that the outer conductor 58 and successive ones of the three inner channels 62 are wound continuously from turn #1 to #14, from turn #15 to #28, and from turn #29 to #42. At some optimum point along turns #14, #28 and #42, the independent electrical current and hydraulic coolant paths separate, in the manner depicted in FIG. 5. Thus, a separate hydraulic coolant path is provided for each of turns #1 through #14, #15 through #28, and #29 through #42, with the electrical current path being continuous from turn #1 through #42.

In FIG. 5. the separation of the coolant channel 62 in the conductor turn #14 is illustrated. The channel 62 is separated into an insulated hydraulic outlet and inlet connections 64,66. A conducting joint 68 is provided to ensure that the electrical path is continuous in the outer conductor 58 even though the coolant flow path is discontinuous. Thus, the electrical current flows across the conducting joint 68 as the coolant fluid separates via the outlet and inlet connections 64,66. The configuration of the coil 50 in FIGS. 3-5 can be called a vertical helical arrangement. It requires that two vertical columns of conductor turns 60 make up each hydraulic flow path.

Figure 6:
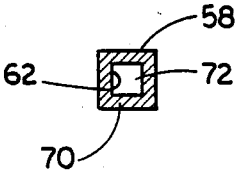
FIG. 6 is an enlarged cross-sectional view of one embodiment of a fragmentary portion of the coil wherein an outer electrical conductor thereof is in the form of a solid metal tube and an inner coolant channel thereof is in the form of a hollow passage formed in the solid tube.
Figure 7:
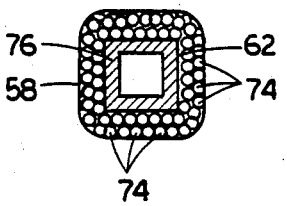
FIG. 7 is an enlarged cross-sectional view of another embodiment of a fragmentary portion of the coil wherein the outer electrical conductor thereof is formed by an annular arrangement of electrically conductive metallic strands and the inner coolant channel thereof is in the form of a low-conductive tube surrounded by the conductive strands.

FIGS. 6 and 7 depict two different embodiments of the conductor 58 and channel 62 composing the coil 50. In FIG. 6, the outer conductor 58 of the coil 50 is in the form of a solid conductive metal tube 70, whereas the inner coolant channel 62 is in the form of a hollow passage 72 formed in the solid tube 70. In FIG. 7, the outer conductor 58 of the coil 50 is in the form of an annular arrangement of electrically conductive metallic strands 74, whereas the inner coolant channel 62 is in the form of a low-conductive hollow tube 76 surrounded by the annular bundle of conductive strands 74. Tube 76 may also be non-conductive.

Figure 8:
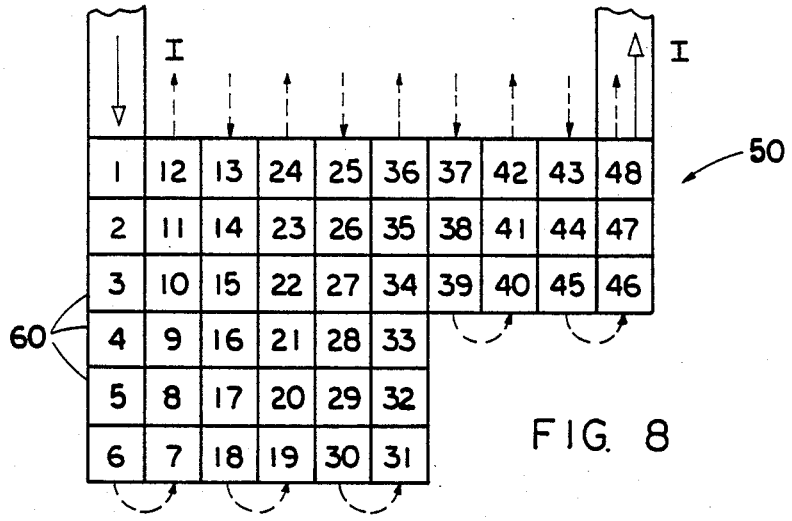
FIGS. 8 to 10 are diagrammatic representations similar to that of FIG. 4, but illustrating several other possible arrangements of the conductor turns and coolant fluid flow paths in the coil.
Figure 9:
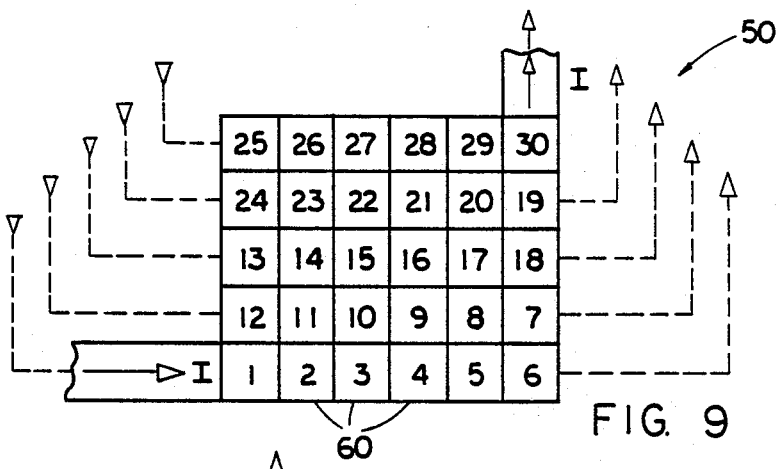
Figure 10:
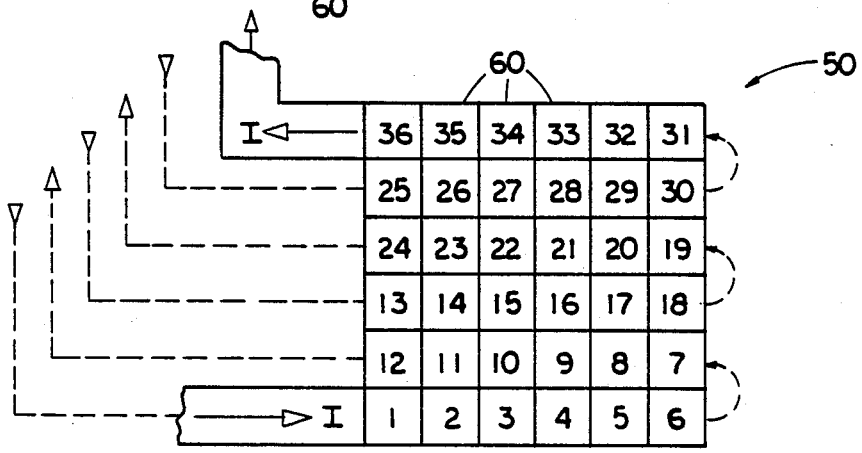

One skilled in the art could readily configure other arrangements of conductor turns 60 and hydraulic coolant channels 62 and still maintain the large number of turns, multiplicity of hydraulic coolant paths and independence between the electrical and hydraulic circuits. Several such arrangements are illustrated in FIGS. 8-10. FIG. 8 merely depicts a variation on the vertical helix wound coil of FIG. 4. FIG. 9 is a configuration called a spiral pancake single layer winding, while the configuration of FIG. 10 is a spiral pancake double layer winding. As in the case of the configuration of FIG. 4, in the respective configurations of FIGS. 8-10 the numbers indicate the winding sequence for electrical current flow in the direction of the solid arrow. The independent and generally parallel flow paths of coolant are represented by the dashed arrows.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the forms hereinbefore described being merely a preferred or exemplary embodiment thereof.

We claim:

1. In a continuous casting machine including a generally horizontal continuous casting mold having an upper inlet, an internal cavity communicating with and disposed below said inlet for receiving molten metal through said inlet into said cavity, and at least one outlet communicating with said cavity for withdrawing a strand of solidifying metal through said outlet from said cavity, and a pouring tube having a outlet nozzle portion, said pouring tube extending from above said mold downwardly through said mold inlet into said mold cavity so as to be disposed its lower outlet nozzle portion in spaced relation below said mold inlet within said mold cavity, a discrete excitation coil supported coxially about said pouring tube within said mold cavity in the space therein between said upper mold inlet and said lower pouring tube outlet nozzle portion, said coil for generating an electromagnetic levitating and stabilizing force which acts upon the meniscus of the molten metal in said mold cavity at the region of said mold inlet for counteracting the head pressure of molten metal contained within said pouring tube and thereby providing a seal in the area of an interface between said mold inlet and said pouring tube above its outlet nozzle portion, said excitation coil comprising:

(a) means defining multiple electrical conductor turns disposed in series and being capable of carrying an electrical current of adequate density to generate said electromagnetic levitating and stabilizing force; and (b) means defining plural hydraulic fluid flow path, the number of said multiple electrical conductor turns being at least six times greater that the number of said plural hydraulic fluid flow paths, said hydraulic fluid flow paths being disposed in parallel to, but independent of, one another and in close proximity to said multiple electrical conductor turns, whereby coolant fluid circulation in each of said independent flow paths can provide sufficient cooling of said multiple turns to facilitate conduction therethrough of a high enough density electrical current to produce said required electromagnetic levitating and stabilizing force for providing said seal in the area of said interface;

(c) said means defining said multiple turns being an outer electrical conductor;

(d) said means defining said plural fluid flow paths being plural inner fluid channels being surrounded by, and in contact with, said outer conductor;

(e) said respective inner channels being separated by hydraulic outlet and inlet connections so as to provide discontinuous coolant flow paths;

(f) said outer conductor at said respective outlet and inlet connections of said inner channels having a conducting joint which ensures that the electrical path in said outer conductor is continuous even through said coolant flow paths are discontinuous.

2. The excitation coil wherein said outer conductor is in the form of a solid conductive metal tube.

3. The excitation coil as recited in claim 2, wherein said inner coolant channels are in the form of hollow passages formed in said solid tube.

4. The excitation coil as recited in claim 1, wherein said outer conductor is in the form of an annular arrangement of electrically conductive metallic strands.

5. The excitation coil as recited in claim 4, wherein said inner coolant channels are in the form of low-conductive tubes surrounded by said conductive strands.

6. The excitation coil as recited in claim 1, wherein said outer conductor and respective inner channels together have a vertical helix winding configuration.

7. The excitation coil as recited in claim 1, wherein said outer conductor and respective inner channels together have a spiral pancake single layer winding configuration.

8. The excitation coil as recited in claim 1, wherein said outer conductor and respective inner channels together have a spiral pancake double layer winding configuration.

* * * * *